US010286265B2

(12) United States Patent
Tsunashima et al.

(10) Patent No.: US 10,286,265 B2
(45) Date of Patent: May 14, 2019

(54) GOLF CLUB HEAD

(71) Applicant: Sumitomo Rubber Industries, Ltd., Kobe-shi, Hyogo (JP)

(72) Inventors: Hiromasa Tsunashima, Kobe (JP); Naruhiro Mizutani, Kobe (JP); Hiroshi Hasegawa, Kobe (JP); Masahide Onuki, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/912,002

(22) Filed: Mar. 5, 2018

(65) Prior Publication Data

US 2018/0250559 A1 Sep. 6, 2018

(30) Foreign Application Priority Data

Mar. 6, 2017 (JP) ..... 2017-041631

(51) Int. Cl.
*A63B 53/04* (2015.01)

(52) U.S. Cl.
CPC .. *A63B 53/0466* (2013.01); *A63B 2053/0408* (2013.01); *A63B 2053/0437* (2013.01)

(58) Field of Classification Search
USPC ..... 473/324–350
See application file for complete search history.

(56) References Cited

U.S. PATENT DOCUMENTS 4,065,133 A * 12/1977 Gordos ..... A63B 53/04 473/327
4,754,974 A * 7/1988 Kobayashi ..... A63B 53/04 473/327
5,092,599 A * 3/1992 Okumoto ..... A63B 53/04 473/327
5,511,786 A * 4/1996 Antonious ..... A63B 53/04 473/327
5,921,872 A * 7/1999 Kobayashi ..... A63B 53/04 473/345
6,001,029 A * 12/1999 Kobayashi ..... A63B 53/04 473/327
6,348,013 B1 * 2/2002 Kosmatka ..... A63B 53/04 473/329
6,783,465 B2 * 8/2004 Matsunaga ..... A63B 53/0466 473/329
7,250,007 B2 * 7/2007 Lu ..... A63B 53/0466 473/329
7,448,961 B2 * 11/2008 Lin ..... A63B 53/04 473/332

(Continued)

FOREIGN PATENT DOCUMENTS

JP 52000538 A * 1/1977
JP 07163685 A * 6/1995 ..... A63B 53/0466

(Continued)

*Primary Examiner* — Alvin A Hunter
(74) *Attorney, Agent, or Firm* — Birch, Stewart, Kolasch & Birch, LLP

(57) ABSTRACT

A golf club head 1 having a hollow (i) therein comprises a face portion 2 having a face 2*a* for striking a ball, a crown portion 3 forming the head top surface, and a sole portion 4 forming a bottom of the head. One of or each of the crown portion 3 and the sole portion 4 is provided with a plurality of grooves bent in the same direction.

11 Claims, 9 Drawing Sheets

(56) References Cited

U.S. PATENT DOCUMENTS

| | | | | |
|---|---|---|---|---|
| 8,403,771 | B1 * | 3/2013 | Rice | A63B 53/04 473/328 |
| 8,435,134 | B2 * | 5/2013 | Tang | A63B 53/04 473/329 |
| 8,540,590 | B2 * | 9/2013 | Tsukada | A63B 53/0466 473/345 |
| 8,608,587 | B2 * | 12/2013 | Henrikson | A63B 53/0466 473/324 |
| 8,827,831 | B2 * | 9/2014 | Burnett | A63B 53/0466 473/329 |
| 8,858,360 | B2 * | 10/2014 | Rice | A63B 53/04 473/329 |
| 8,956,242 | B2 * | 2/2015 | Rice | A63B 53/0466 473/329 |
| 9,011,265 | B2 * | 4/2015 | Stites | A63B 53/0466 473/327 |
| 9,079,079 | B2 * | 7/2015 | Fossum | A63B 53/0466 |
| 9,089,749 | B2 * | 7/2015 | Burnett | A63B 53/0466 |
| 9,126,084 | B2 * | 9/2015 | Stokke | A63B 53/0466 |
| 9,168,432 | B2 * | 10/2015 | Henrikson | A63B 53/0466 |
| 9,242,152 | B2 * | 1/2016 | Cole | A63B 53/0466 |
| 9,320,948 | B2 * | 4/2016 | Fossum | A63B 53/0466 |
| 9,421,434 | B2 * | 8/2016 | Takagi | A63B 53/0466 |
| 9,682,293 | B2 * | 6/2017 | Bennett | A63B 53/0466 |
| 9,700,768 | B2 * | 7/2017 | Cole | A63B 53/0466 |
| 9,839,819 | B2 * | 12/2017 | Mizutani | A63B 60/52 |
| 9,908,012 | B2 * | 3/2018 | Larson | A63B 53/0466 |
| 2014/0080627 | A1 | 3/2014 | Bennett et al. | |

FOREIGN PATENT DOCUMENTS

| | | | | | |
|---|---|---|---|---|---|
| JP | 09215789 | A | * | 8/1997 | |
| JP | 10263118 | A | * | 10/1998 | |
| JP | 2001353240 | A | * | 12/2001 | |
| JP | 2002052099 | A | * | 2/2002 | |
| JP | 2002239641 | A | * | 8/2002 | A63B 53/0466 |
| JP | 2003093554 | A | * | 4/2003 | A63B 53/0466 |
| JP | 2007136069 | A | * | 6/2007 | A63B 53/0466 |
| JP | 2008200118 | A | * | 9/2008 | |
| JP | 2014180540 | A | * | 9/2014 | |
| JP | 2016-182356 | A | | 10/2016 | |

* cited by examiner

GOLF CLUB HEAD

TECHNICAL FIELD

The present invention relates to a golf club head having a hollow therein.

BACKGROUND ART

Heretofore, various attempts have been made in order to improve the rebound performance of a golf club head and thereby to increase the flight distance of the golf ball.

Japanese patent application publication No. 2016-182356 discloses a golf club head whose sole portion is provided along the leading edge thereof with a flexure extending in the toe-heel direction of the head.

SUMMARY OF THE INVENTION

Problems to be Solved by the Invention

The present inventors carried out various analyzes of rebound performance of golf club heads on the basis of a structure where one of or each of the crown portion and sole portion is provided with a groove, and found that the rebound performance can be significantly improved by providing a plurality of grooves bent in the same direction or a groove bent in a particular direction.

It is therefore, an object of the present invention to provide a golf club head in which the rebound performance is improved in order to increase the flying distance of the hit ball.

According to one aspect of the present invention, a golf club head having a hollow therein comprises:

a face portion having a face for striking a ball, a crown portion forming a top surface of the head, and a sole portion forming a bottom surface of the head, wherein one of or each of the crown portion and the sole portion is provided with a plurality of grooves bent in the same direction.

The above-said a plurality of grooves may be arranged concentrically.

The above-said a plurality of grooves may be curved convexly to the rear of the golf club head.

Each of the above-said a plurality of grooves may have a toe-side first end disposed on a face side, a heel-side second end disposed on a face side and located on a heel side of the toe-side first end, and a back side portion extending at a position on the back side of the toe-side first end and the heel-side second end.

The above-said a plurality of grooves may be arcuate.

The above-said a plurality of grooves may have radii of curvature in a range from 3 to 100 mm.

The above-said a plurality of grooves may be bent in polygonal lines.

The number of the above-said a plurality of grooves may be three or more.

The above-said a plurality of grooves may be arranged in the front-back direction of the head.

The above-said a plurality of grooves may be shifted toward a toe of the head.

The above-said a plurality of grooves may be shifted toward a heel of the head.

The above-said a plurality of grooves may be arranged in a heel side of the head and also in a toe side of the head.

According to another aspect of the present invention, a golf club head having a hollow therein comprises:

a face portion having a face for striking a ball, a crown portion forming a top surface of the head, and a sole portion forming a bottom of the head, wherein one of or each of the crown portion and the sole portion is provided with a groove bent convexly to the rear of the golf club head.

Therefore, in the golf club heads according to the present invention, by the provision of the specifically bent or curved groove(s), the rebound performance is improved, and thereby, the flight distance of the ball is increased.

DESCRIPTION OF THE PREFERRED EMBODIMENTS

Embodiments of the present invention will now be described in conjunction with accompanying drawings.

The specific configurations described in the following embodiments and illustrated by the drawings are only for understanding the present invention, and not intended to limit the present invention to those specific configurations.

Figure 1:
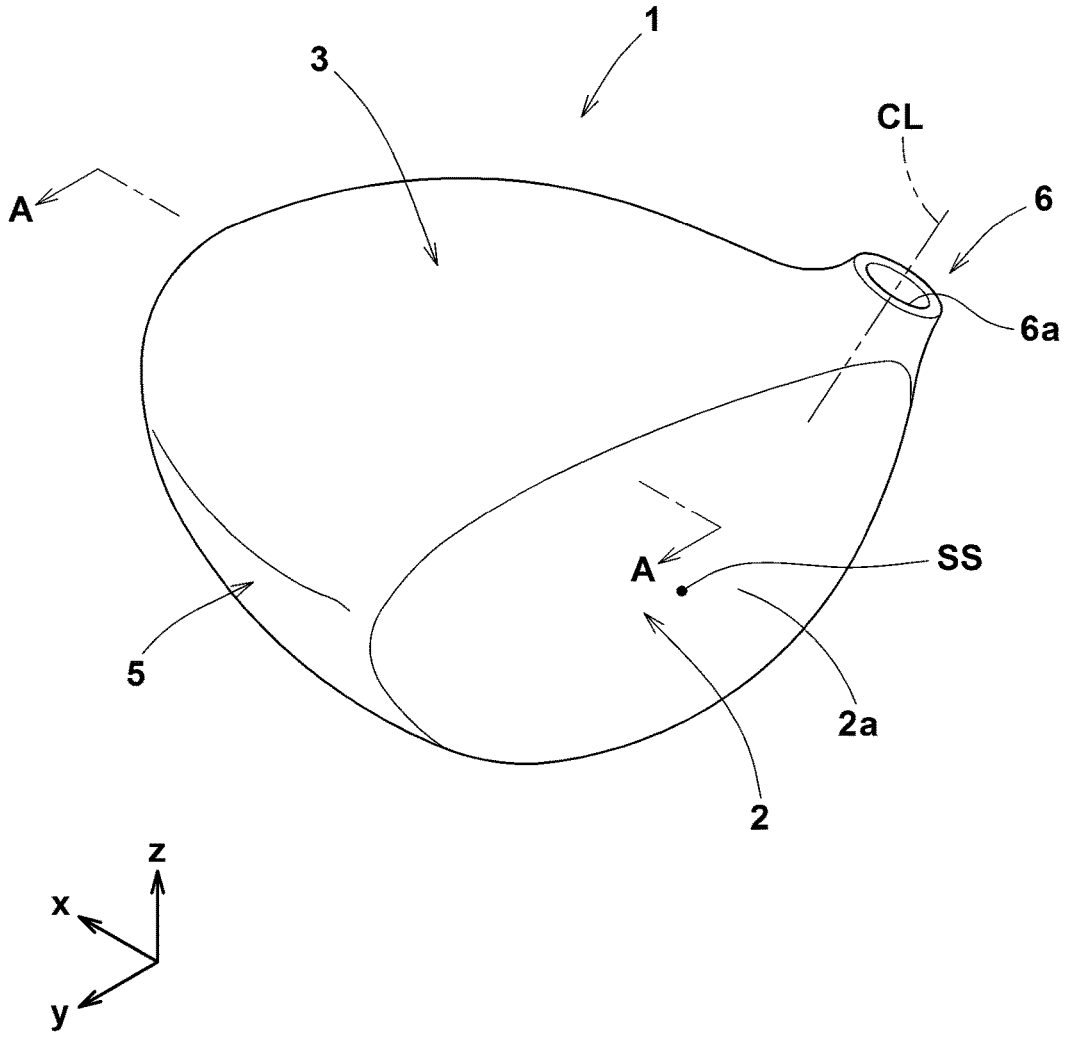
FIG. 1 is a perspective view of a golf club head as an embodiment of the present invention.
Figure 2:
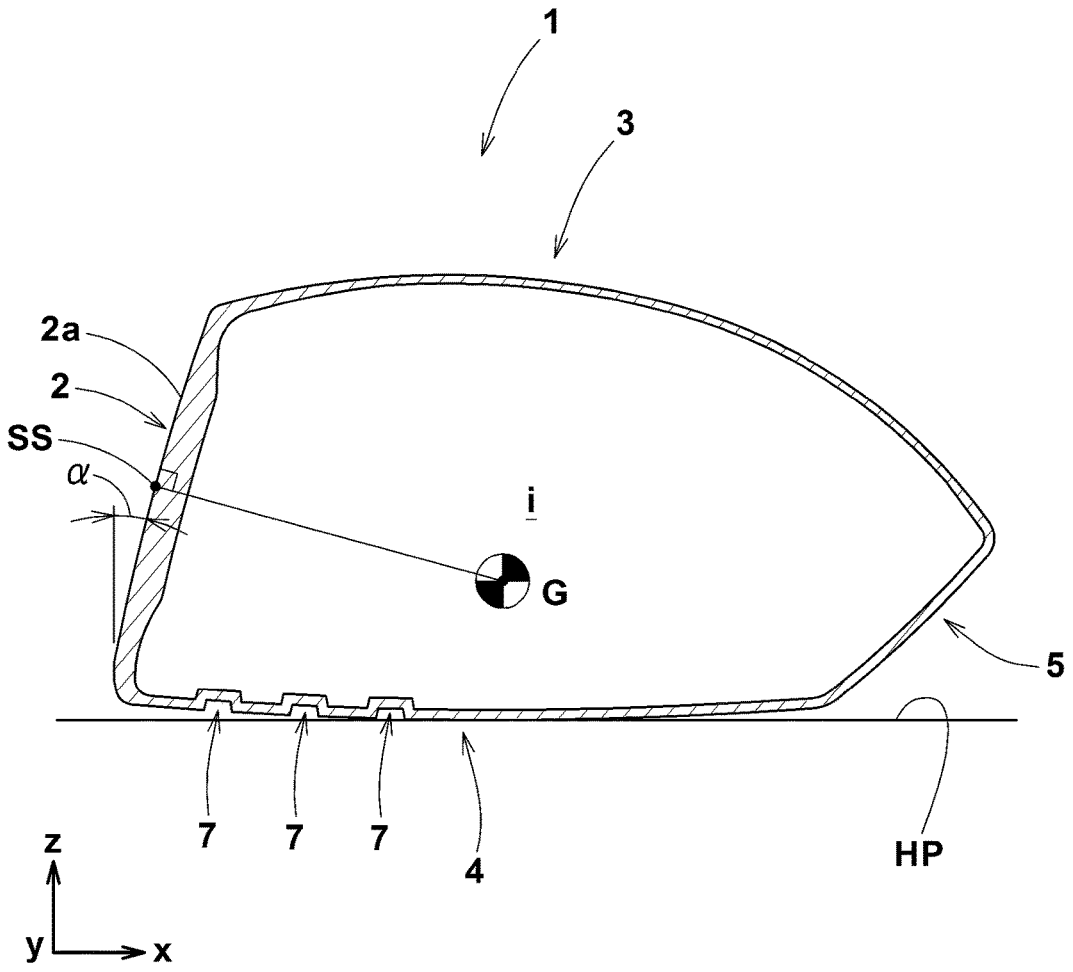
FIG. 2 is a cross sectional view thereof taken along line A-A of FIG. 1.
Figure 3:
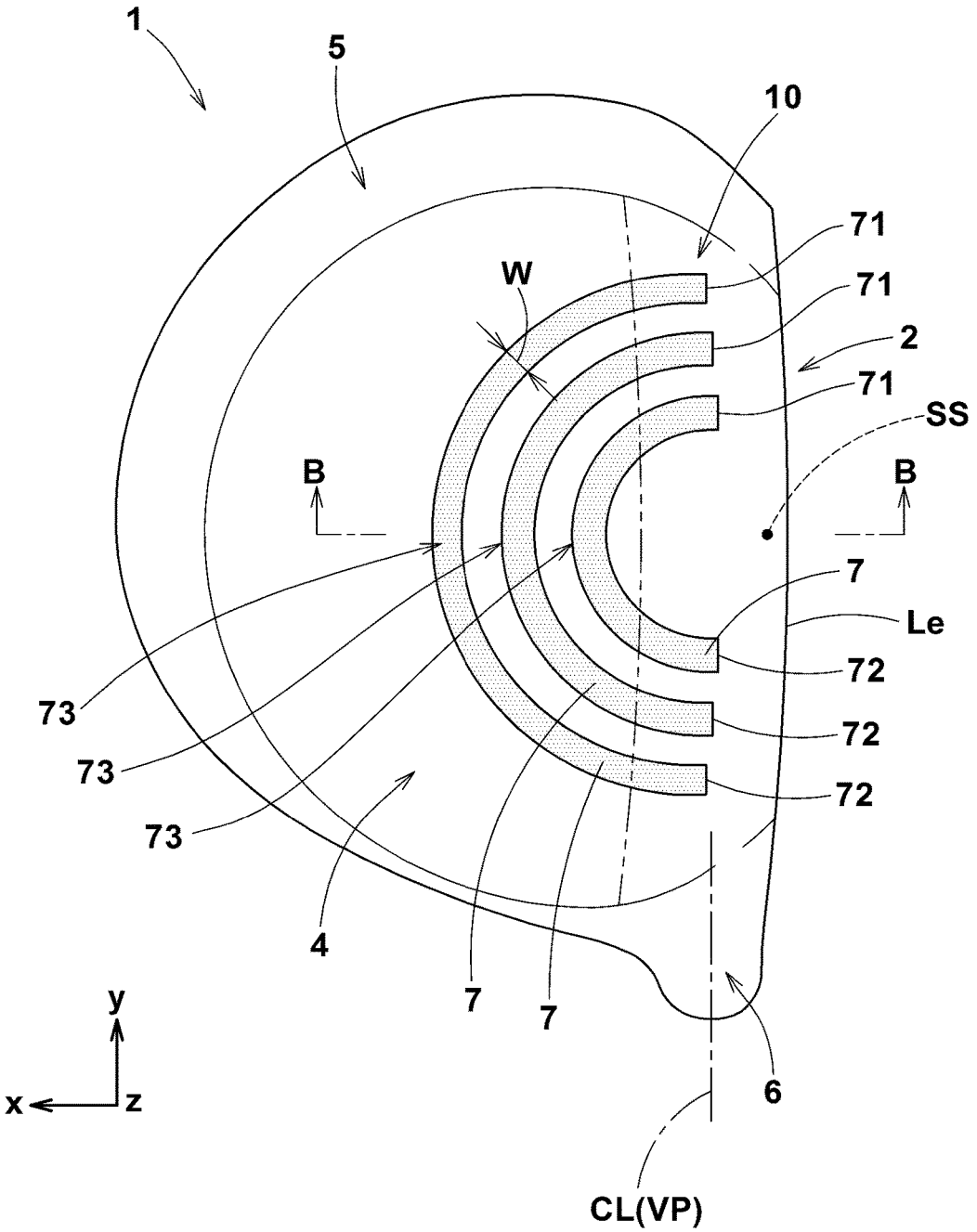
FIG. 3 is a bottom view of the golf club head.

FIGS. 1-3 show a golf club head 1 as an embodiment of the present invention under its standard state.

Here, the standard state of the club head is such that the club head is set on a horizontal plane HP so that the axis CL of the club shaft (not shown) is inclined at the specified lie angle while keeping the axis on a vertical plane, and the face forms the specified loft angle $\alpha$ with respect to the horizontal plane HP. Incidentally, in the case of the club head alone, the center line of the shaft inserting hole can be used instead of the axis CL of the club shaft.

"Front-back direction" is a direction (x) parallel with a straight line (shown in FIG. 2) projected on the horizontal plane HP, wherein the straight line is drawn normally to the face 2*a* passing through the center G of gravity of the club head.

"Toe-heel direction" is a direction (y) parallel with the horizontal plane HP and perpendicular to the front-back direction.

"up-down direction" is a direction (z) perpendicular to the horizontal plane HP.

In this application, dimensions, positions, directions and the like relating to the club head refer to those under the standard state of the club head unless otherwise noted.

In this embodiment, the club head 1 is a wood-type head having a hollow (i) therein as shown in FIGS. 1-3. For example, it is designed for a driver (#1 wood).

Here, the "wood-type" is meant for at least number 1 to 5 woods as well as clubs comprising heads having similar shapes thereto, therefore, a wood-type head is meant for the head of such a wood-type golf club.

However, the present invention may be embodied as heads for utility-type clubs and iron-type clubs.

The club head 1 comprises a face portion 2, a crown portion 3, a sole portion 4, and a side portion 5.

The face portion 2 has a front surface defining a club face 2*a* for striking a ball.

The crown portion 3 extends from the face portion 2 so as to define the upper surface of the head.

The sole portion 4 extends from the face portion 2 so as to define the bottom surface of the head.

The side portion 5 between the crown portion 3 and the sole part 4 extends from a toe side part to a heel side part of the face portion 2 through the rear of the head.

The face portion 2, the crown portion 3, the sole portion 4 and the side portion 5 form a hollow shell structure having a hollow (i) therein.

In a heel side of the crown portion 3 for example, a hosel 6 to be attached to a tip end of a club shaft (not shown) is provided. The hosel 6 is formed in a cylindrical shape and provided with a shaft inserting hole 6*a*.

Incidentally, the center line of the shaft insertion hole 6*a* corresponds to the axis CL of the club shaft.

According to one aspect of the present invention, only one of or each of the crown portion 3 and the sole portion 4 is provided with a plurality of grooves 7 which are bent in the same direction.

In the present embodiment, the grooves 7 are formed only in the sole portion 4.

The groove 7 provides a low rigidity part to the sole portion 4. Thus, when the face 2*a* strikes a ball, the grooved part (7) and surrounding part of the sole portion 4 are bent relatively largely. This improves the rebound performance of the head 1. In particular, the grooves 7 which are bent in the same direction as in the present embodiment, exert a large effect of improving the rebound performance as compared with linear grooves.

FIGS. 4(A)-4(D) shows various examples of the cross section of the groove 7 taken along line B-B of FIG. 3.

Figure 4A:
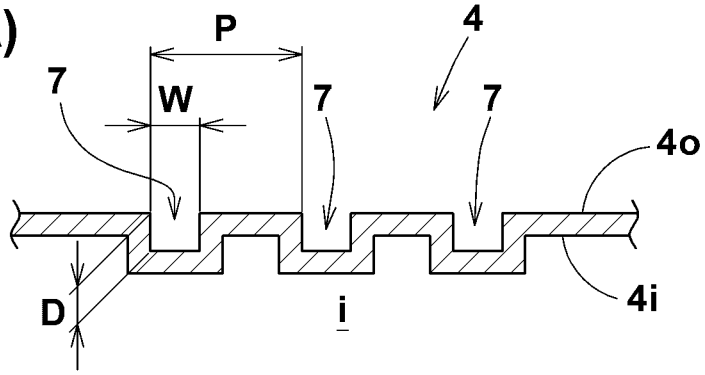
FIGS. 4(A)-4(D) are sectional views of various examples of the grooves provided in the sole portion taken along line B-B of FIG. 3.

In the example shown in FIG. 4(A), the grooves 7 are formed by bending the material constituting the sole portion 4, therefore, uneven (or grooves) is formed in both the outer surface 4*o* and the inner surface 4*i* of the sole portion 4.

In this example, each of the grooves 7 has a rectangular cross sectional shape, but it is not limited to such shape. For example, it may be arcuate, U-shaped or V-shaped.

Figure 4B:
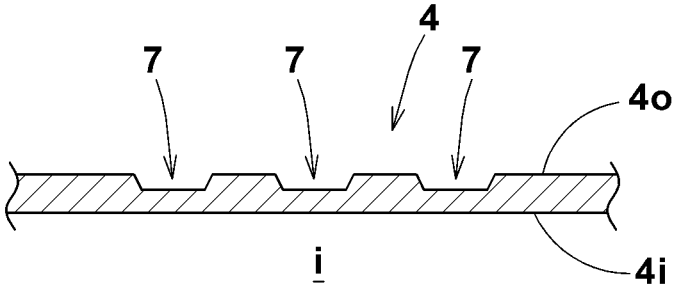
Figure 4C:
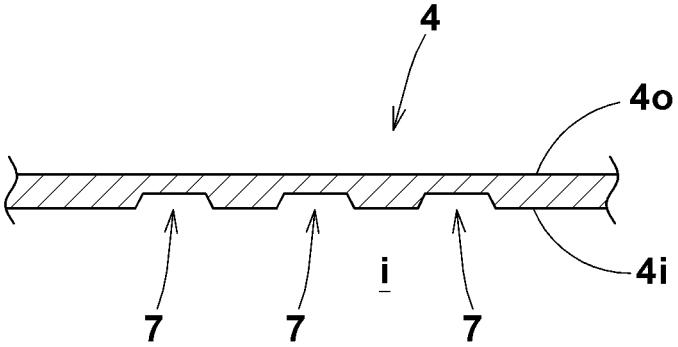

In the example shown in FIG. 4(B), the grooves 7 are formed only in the outer surface 4*o* of the sole portion 4, and the inner surface 4*i* is smooth.

In the example shown in FIG. 4(*c*), the grooves 7 are formed only in the inner surface 4*i* of the sole portion 4, and the outer surface 4*o* is smooth.

Figure 4D:
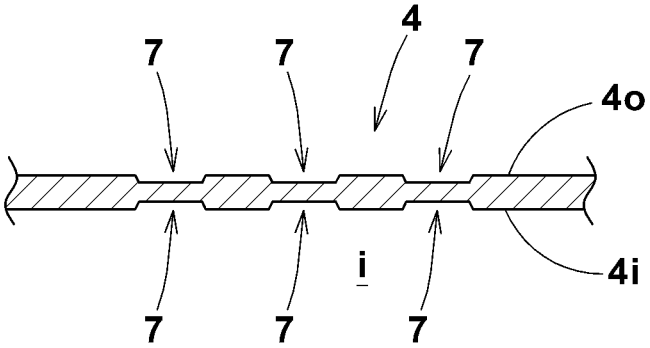

In the example shown in FIG. 4(D), the grooves 7 are formed in both the outer surface 4*o* and the inner surface 4*i* of the sole portion 4 so that the grooves 7 in the outer surface 4*o* are disposed at the same positions as the grooves 7 in the inner surface 4*i*, respectively.

As shown in FIG. 3, the sole portion 4 (or the crown portion 3) is provided with two or more grooves 7. Preferably, the number of the grooves 7 is three or more.

The upper limit of the number of the grooves 7 may be determined in consideration of the area of the sole portion 4, the widths w of the grooves 7, and/or the durability of the sole portion 4, and it is for example, not more than 10, preferably not more than 8.

In the present embodiment, the grooves 7 are arranged in the front-back direction of the head at intervals, and the number of the grooves 7 is not more than 10.

In the present embodiment, all the grooves 7 are arranged concentrically. Thus, the grooves 7 are arranged adjacently to each other so as to curve in the same direction. In the example of FIG. 3, the grooves 7 are curved convexly toward the backside of the head.

It is preferable that the grooves 7 have substantially similar shapes to each other.

Here, the "substantially similar shapes" mean not only similar shapes in the mathematical sense but also shapes which are, at first glance, recognized such that they are based on one geometric configuration (e.g., triangle, square, circle, etc.) and their differences are only the sizes.

By the above-described arrangement of the grooves 7, it becomes possible that the arrangement pattern of the curved grooves 7 approximates the spreading pattern of the impact wave which occurs at the time of striking a ball and is transmitted (spread) in the sole portion 4 from the face 2*a* toward the rear thereof. Thus, when striking a ball, such arrangement can provide a preferred bending mode for the sole portion 4 so as to further improve the rebound performance of the head 1.

In the present embodiment, each of the grooves 7 has a toe-side first end 71 and a heel-side second end 72 which are positioned on the toe side and heel side of the head, respectively, in a face portion side of the head.

Preferably, the toe-side first end 71 and heel-side second end 72 are positioned adjacently to the face part 2, more specifically, positioned within a face-side zone 10 which is defined as extending from the leading edge Le of the head toward the backside of the head by 30 mm, preferably 20 mm in the bottom view of the head.

Figure 7:
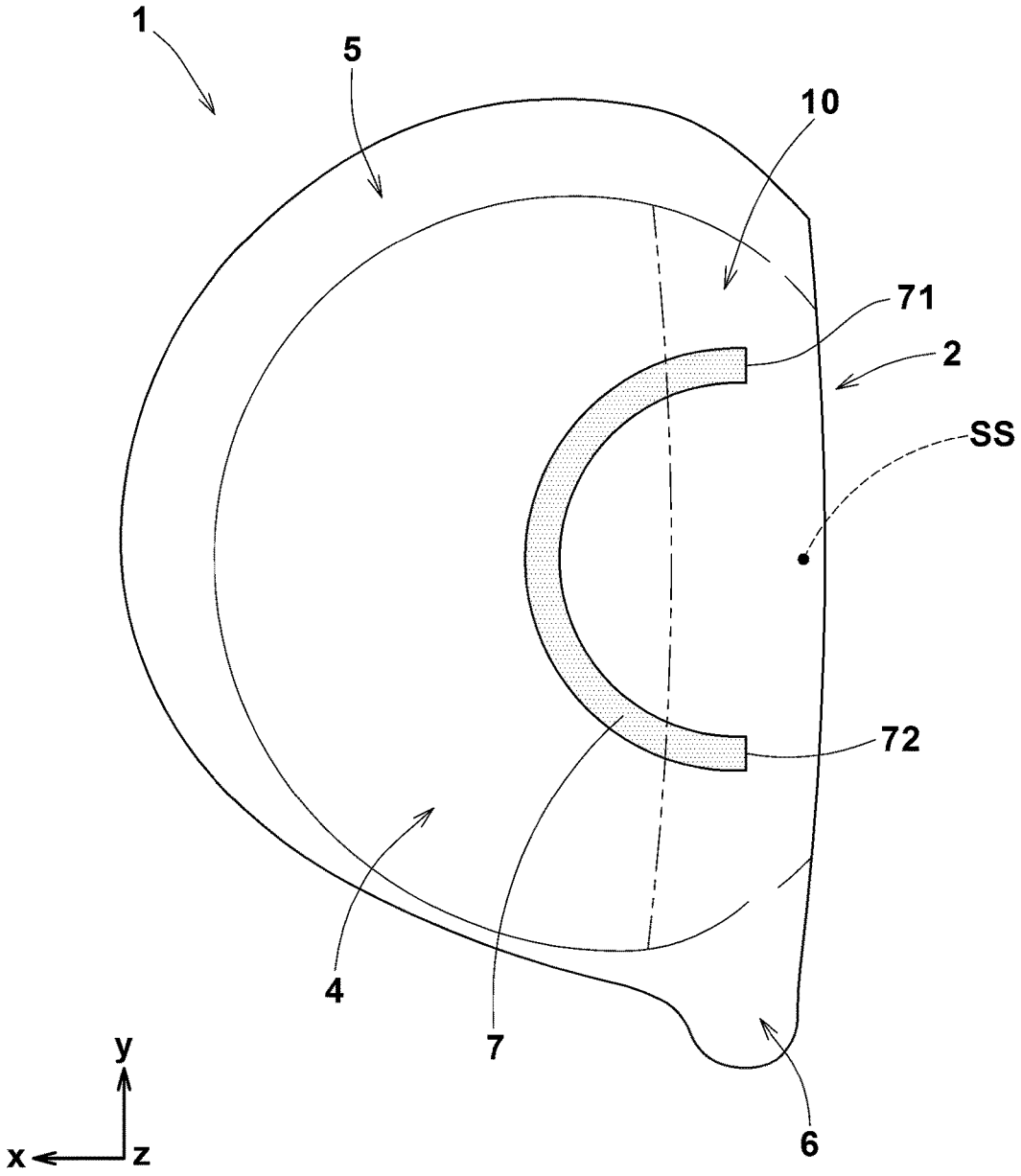
FIG. 7 is a bottom view of a golf club head as another embodiment of the present invention showing the sole portion provided with a single groove.
Figure 8A:
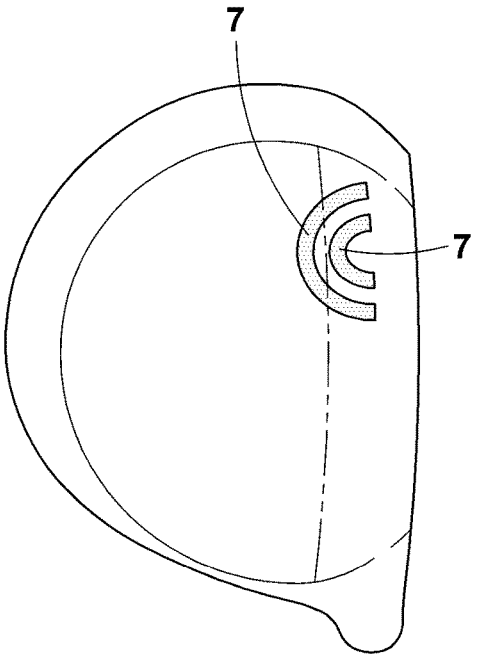
FIGS. 8(A)-8(c) are bottom views of various examples of the arrangements of the grooves.
Figure 8B:
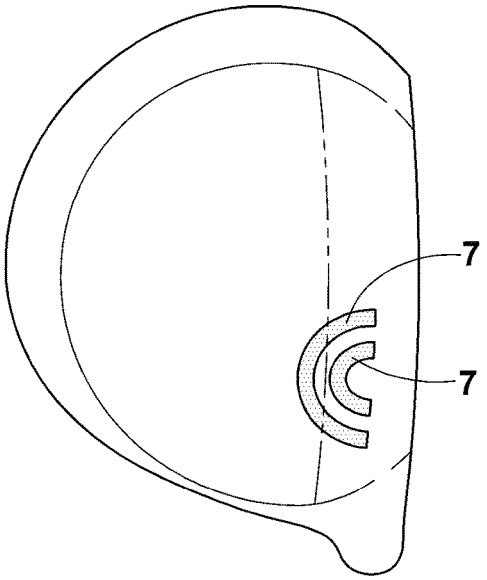
Figure 8C:
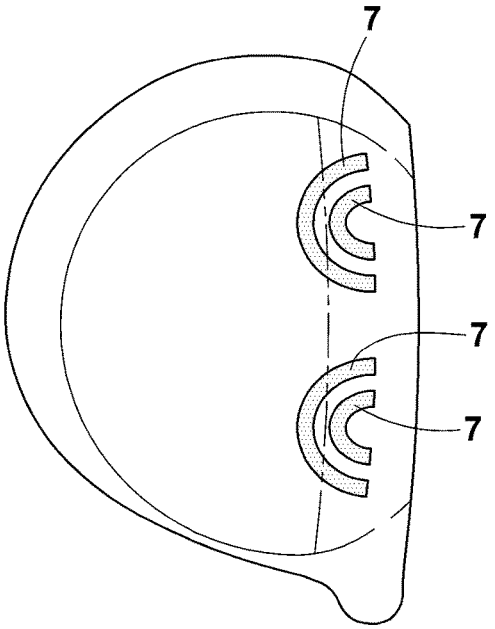

The boundary line of the face-side zone 10 is shown by chain double-dashed line in FIGS. 3, 7 and 8.

By this arrangement, a more preferred transformation as described above can be provided for the sole portion 4 during striking a ball.

It is desirable that the rearmost position of the grooves 7 as a whole is at a distance of not greater than 100 mm, preferably not greater than 80 mm, more preferably not greater than 60 mm from the leading edge Le.

Preferably, at least one of, more preferably each of the grooves 7 is positioned so that the toe-side first end 71 and the heel-side second end 72 are respectively located on the toe side and heel side of the sweet spot ss of the face 2*a*. However, it is also possible that all or some of the grooves 7 are positioned so that the toe-side first ends 71 and heel-side second ends 72 are located on the toe side or alternatively on the heel side of the sweet spot ss of the face 2*a*.

Here, the sweet spot SS is defined as a position at which a normal line which is drawn to the face 2*a* from the center G of gravity of the head, intersects the face 2*a* as shown in FIG. 2.

Each of the grooves 7 has a back side portion 73 between the toe-side first end 71 and the heel-side second end 72. The back side portion 73 extends in a region posterior to the toe-side first end 71 and heel-side second end 72.

In the present embodiment, the back side portion 73 is curved convexly toward the rear of the head 1.

The arrangement pattern of such grooves 7 more approximates the spreading pattern of the impact wave, and the rebound performance of the head 1 can be further improved.

Preferably, the rearmost positions of the back side portions 73 of the grooves 7 reside in a range of 10 mm toward the toe and toward the heel from the straight line drawn from the sweet spot ss toward the backside of the head in the bottom view of the head. More preferably, the rearmost positions reside on the straight line.

As the pattern of the grooves 7 which are curved convexly toward the rear of the head 1, it is preferred that each of the grooves 7 is curved in an arc shape in the bottom view of the head.

In the present embodiment, the grooves 7 are arranged in a concentric manner.

Here, the expression "arranged in a concentric manner" means not only that the curves of the grooves 7 have a common center but also that the grooves 7 are, at first glance, recognized such that their curves have a common center.

Such pattern or arrangement of the grooves 7 can further improve the rebound performance of the head 1 as the pattern of the grooves 7 more approximates the spreading pattern of the impact wave.

When the groove 7 is curved in an arc shape, the radius R of curvature is preferably set in a range from 3 to 100 mm, more preferably 5 to 50 mm.

Here, the radius R of curvature is of the widthwise center line of the groove 7 in the bottom view of the head 1.

The above expression "an arc shape" may include not only a single radius arc but also an arc whose radius is gradually changed such as a part of an ellipse.

The widths W, depths D and pitches P of the grooves 7 (shown in FIG. 4(A)) can be determined arbitrarily.

However, the width w of the groove 7 is preferably set in a range of about 0.5 to 20 mm, more preferably about 2 to 10 mm. The depth D of the groove 7 is preferably set in a range of about 0.1 to 10 mm, more desirably about 1 to 2 mm.

The pitch P of the grooves 7 is preferably set in a range from 0.1 to 5.0 times, more preferably about 0.5 to 2.0 times the width w of the groove 7.

In the respective groove 7, the width w and the depth D may be constant or may be varied.

As an example, the width w and/or the depth D of the groove 7 can be decreased at the toe-side first end 71 and the heel-side second end 72 and increased in the back side portion 73. Such configuration makes it possible to largely deflect the sole portion 4 when striking a ball.

Contrary to the above, the width W and/or the depth D of the groove 7 can be increased at the toe-side first end 71 and the heel-side second end 72 and decreased in the back side portion 73.

Further, with respect to the width w and the depth D, the grooves 7 may differ from each other.

As an example, it is possible to increase the width w and/or the depth D as the groove 7 is located more ahead with respect to the head. By such configuration, it is possible to deflect the sole portion 4 largely during striking a ball.

Further, it is also possible to decrease the width w and/or the depth D as the groove 7 is located more ahead with respect to the head.

The arrangement pitches P of the grooves 7 may be constant or may be varied.

FIG. 5(A)-5(G) show further examples of the pattern and configuration of the grooves 7, wherein the grooves 7 are tinted for the viewability.

FIG. 5(A)-5(G) are bottom views, therefore, the grooves 7 provided in the sole part 4 are shown. However, the patterns and configurations shown can be applied to the grooves provided in the crown portion.

Figure 5A:
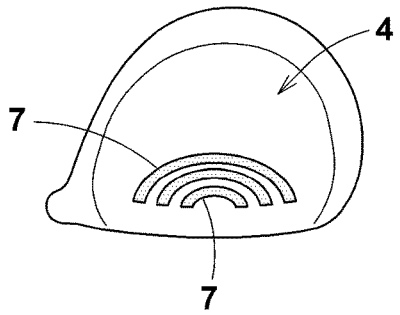
FIGS. 5(A)-5(G) are bottom views showing various examples of the arrangements of the grooves.

In the example shown in FIG. 5(A), each of the grooves 7 is formed based on an arc of an ellipse formed by flattening a circular arc in the front-back direction of the head, and thus smoothly curved.

Figure 5B:
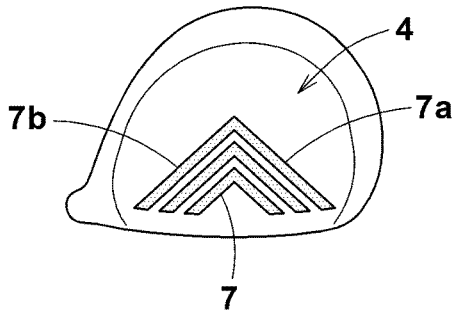
Figure 5C:
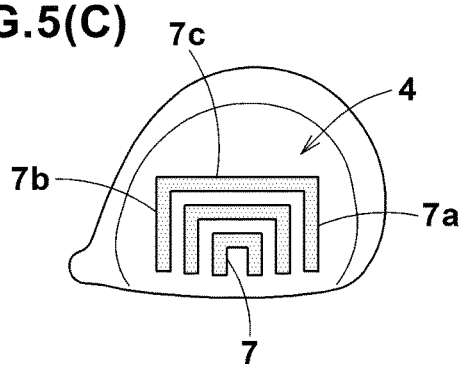

In the example shown in FIG. 5(B), each of the grooves 7 is composed of a toe-side element 7*a* and a heel-side element 7*b* which are inclined in opposite directions to each other, and thus bent in a v-shape. The two elements 7*a* and 7*b* are substantially straight, and intersect with each other at an acute angle in this example. However, it is also possible to connect the two elements 7*a* and 7*b* by an arc-shaped element.

In the example shown in FIG. 5(*c*), each of the grooves 7 is composed of a central element 7*c* which extends in the toe-heel direction, and a toe-side element 7*a* and a heel-side element 7*b* which extend in the front-back direction of the head from the respective ends in the toe-heel direction of the central element 7*c* toward the face. The three elements 7*a*-7*c* are substantially straight, and form a rectangular shape from which one side is removed. However, it is also possible to connect the adjacent elements by an arc-shaped element.

Figure 5D:
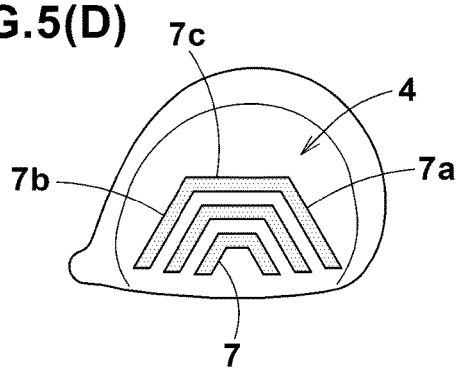

In the example shown in FIG. 5(D), each of the grooves 7 is composed of a central element 7*c* which extends in the toe-heel direction, and a toe-side element 7*a* and a heel-side element 7*b* which extend obliquely from the respective ends in the toe-heel direction of the central element 7*c* toward the face and toward the toe and heel, respectively.

The three elements 7*a*-7*c* are substantially straight, and form a trapezoidal shape from which one side (lower base) is removed. However, it is also possible to connect the adjacent elements by an arc-shaped element.

Figure 5E:
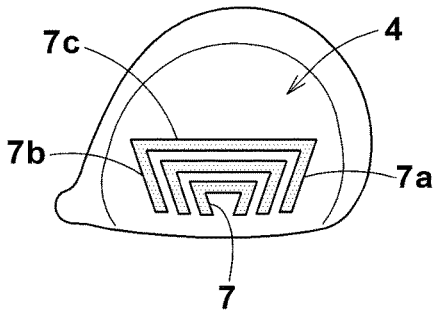

In the example shown in FIG. 5(E), each of the grooves 7 is composed of a central element 7*c* which extends in the toe-heel direction, and a toe-side element 7*a* and a heel-side element 7*b* which extend obliquely from the respective ends in the toe-heel direction of the central element 7*c* toward the face and toward the heel and toe, respectively (inverse of FIG. 5(D)). The three elements 7*a*-7*c* are substantially straight, and form a trapezoidal shape from which one side (upper base) is removed. However, it is also possible to connect the adjacent elements by an arc-shaped element.

Figure 5F:
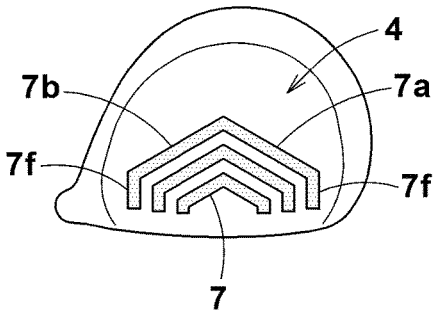
Figure 5G:
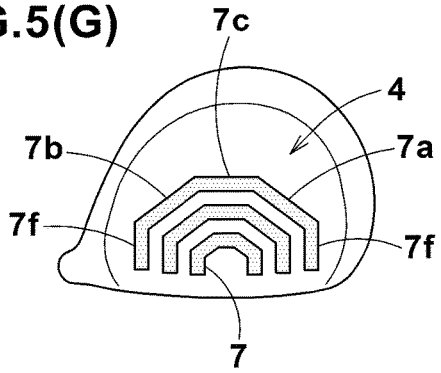

In the example shown in FIG. 5(F), each groove 7 is a modification of the v-shaped groove 7 shown in FIG. 5(B), wherein the groove 7 further includes two elements 7*f* extending in the front-back direction of the head from the respective front ends of the toe-side element 7*a* and the heel-side element 7*b*. The four elements 7*a*, 7*a*, 7*f* and 7*f* are substantially straight. It is also possible to connect the adjacent elements by an arc-shaped element.

In the example shown in FIG. 5 (G), each groove 7 is a modification of the trapezoidal groove 7 shown in FIG. 5(D), wherein the groove 7 further includes two elements 7*f* extending in the front-back direction of the head from the respective front ends of the toe-side element 7*a* and the heel-side element 7*b*. The five elements 7*a*, 7*a*, 7*c*, 7*f* and 7*f* are substantially straight. It is also possible to connect the adjacent elements by an arc-shaped element.

Figure 6:
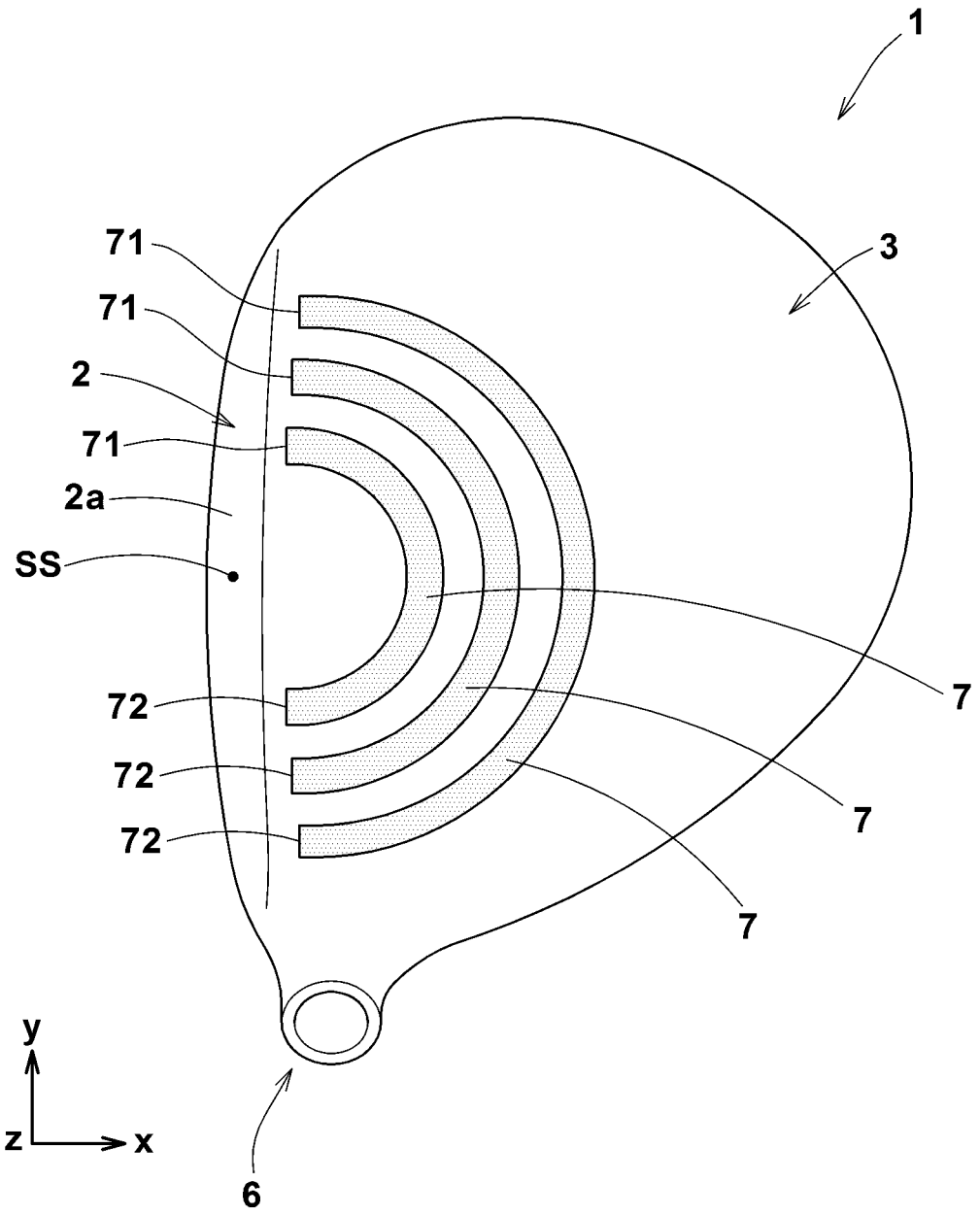
FIG. 6 is a top view of a golf club head according to the present invention showing the crown portion provided with grooves.

In the above-described embodiments, the grooves 7 are disposed in the sole portion 4, but can be disposed in the crown portion 4 as shown in FIG. 6.

The above-described grooves 7 can be disposed in the crown portion 4 or the sole portion 4 or each of them. In either case, it is possible to obtain the above-described effect. Incidentally, all features relating to the grooves 7 described with reference to FIGS. 1 to 5 may be applied to the embodiment shown in FIG. 6.

According to another aspect of the present invention, one of or each of the crown portion 3 and the sole portion 4 is provided with at least one groove 7 curved convexly toward the rear of the head.

FIG. 7 shows such embodiment of the present invention, wherein the sole portion 4 is provided with a single groove 7 curved convexly toward the rear of the head. In this embodiment too, the groove 7 reduces the rigidity locally, and the grooved part and surrounding part are bent relatively largely during striking a ball. This improves the rebound performance of the head 1.

FIGS. 8(A)-8(B) each show still another embodiment of the present invention.

In the embodiment shown in FIG. 8(A), the above-said a plurality of grooves 7 are shifted toward the toe. This arrangement is suitable for a golfer hitting balls on the toe side of the center.

In the embodiment shown in FIG. 8(B), the above-said a plurality of grooves 7 are shifted toward the heel. This arrangement is suitable for a golfer hitting balls on the heel side of the center.

In the embodiment shown in FIG. 8 (C), the above-said a plurality of grooves 7 are disposed on each of the toe side and the heel side of the center. This arrangement can improve the rebound performance even if a ball hits a toe side or heel side of the center.

Such arrangements are made on the sole portion 4, but it is also possible to make such arrangement on the crown portion 3.

While detailed description has been made of preferable embodiments of the present invention, the present invention can be embodied in various forms without being limited to the illustrated embodiments.

In particular, the illustrated embodiments should not be strictly construed as being independent of each other.

For example, some of the features of an embodiment can be replaced with some of the features of another embodiment, and some of the features of an embodiment can be combined with another embodiment.

Comparison Test

In order to confirm the effect of the present invention, hollow titanium alloy golf club heads shown in FIG. 9(A)-9(D) were prepared and tested for the rebound performance. All of the heads had the same structure except for grooves. Specifications of the heads are as follows.

Figure 9A:
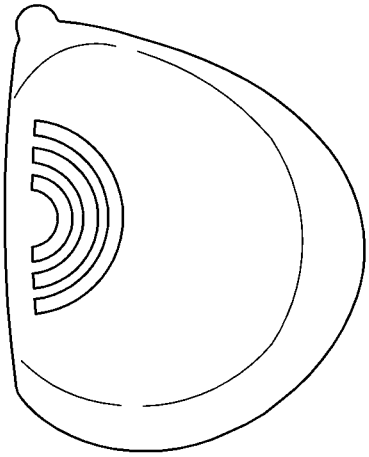
FIGS. 9(A)-9(D) are top views and bottom views of golf club heads used as working Example and Comparative Example.

[Working Example 1: FIG. 9(A)]

In the head as working Example 1, three arc-shaped grooves were concentrically formed in the sole portion. The centers of curves of the grooves were positioned on a straight line drawn backward from the sweet spot in parallel with the front-back direction.

Specifications of the grooves are as follows.

Groove width: 5 mm

Groove depth: 2 mm

Arrangement pitches: 8 mm (1.6 times the groove width)

Curves of Grooves: 3 kinds of single arcs of 10.8 mm, 18.8 mm and 26.8 mm

Figure 9B:
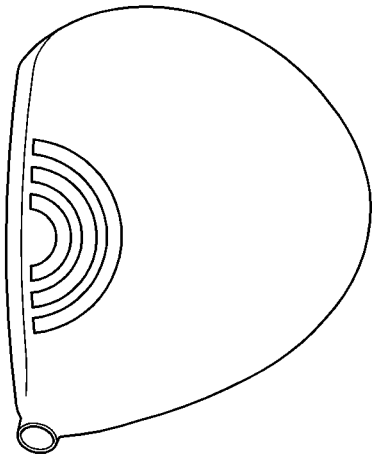

[Working Example 2: FIG. 9(B)]

In the head as working Example 2, three arc-shaped grooves were concentrically formed in the crown portion. The centers of curves of the grooves were positioned on a straight line drawn backward from the sweet spot in parallel with the front-back direction.

Specifications of the grooves are the same as those in working Example 1.

Figure 9C:
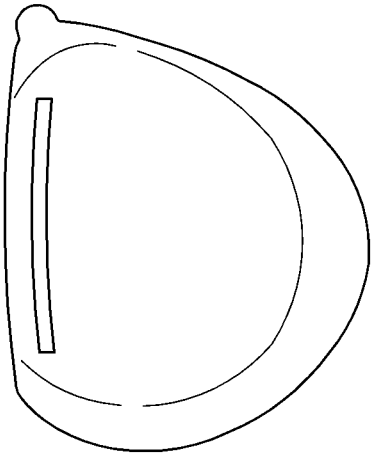

[Comparative Example 1: FIG. 9(C)]

In the head as Comparative Example 1, a single groove extending straight in the toe-heel direction was formed in the sole portion.

Specifications of the grooves are as follows.

Groove width: 5 mm

Groove depth: 3.5 mm

Figure 9D:
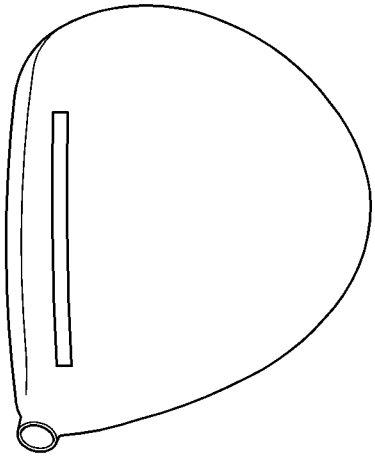

[Comparative Example 2 FIG. 9(D)]

In the head as Comparative Example 2, a single groove extending straight in the toe-heel direction was formed in the crown portion. Specifications of the grooves are the same as those in Comparative Example 1.

<Rebound Performance Test>

The rebound performance of the head was evaluated by the coefficient of restitution (COR). The coefficient of restitution (COR) was obtained from the velocity ratio of the ball rebound velocity to the ball incoming velocity measured according to the procedure specified by united states Golf Association.

The measured values of COR are indicated in Table 1 by an index based on Comparative Example 1 being 100, wherein the larger the value, the better the rebound performance.

TABLE 1

| | Comparative Ex. 1 | Comparative Ex. 2 | Working Ex. 1 | Working Ex. 2 |
|---|---|---|---|---|
| COR | 100 | 98 | 104 | 102 |

From the test results, it was confirmed that working Examples 1 and 2 were significantly improved in the restitution coefficient as compared with Comparative Examples 1 and 2.

DESCRIPTION OF THE REFERENCE SIGNS

1 golf club head
2 face portion
2*a* face
3 crown portion
4 sole portion
7 groove
71 toe-side first end
72 heel-side second end
73 back side portion
i hollow

The invention claimed is:

1. A golf club head having a hollow therein and comprising:

a face portion having a face for striking a ball;

a crown portion forming a top surface of the head; and a sole portion forming a bottom of the head, wherein one of or each of the crown portion and the sole portion is provided with a plurality of grooves bent in a same direction, and wherein said plurality of grooves are arcuate and have radii of curvature in a range from 3to 100 mm.

2. The golf club head according to claim 1, wherein said plurality of grooves are arranged concentrically.

3. The golf club head according to claim 1, wherein said plurality of grooves are curved convexly to the rear of the golf club head.

4. The golf club head according to claim 1, wherein each of said plurality of grooves has a toe-side first end disposed on a face side, a heel-side second end disposed on a face side and located on a heel side of the toe-side first end, and a back side portion extending at a position on the back side of the toe-side first end and the heel-side second end.

5. The golf club head according to claim 1, wherein said plurality of grooves are bent in polygonal lines.

6. The golf club head according to claim 1, wherein the number of said plurality of grooves is three or more.

7. The golf club head according to claim 6, wherein said plurality of grooves are arranged in a front-back direction of the head.

8. A golf club head having a hollow therein and comprising:

a face portion having a face for striking a ball;

a crown portion forming a top surface of the head; and a sole portion forming a bottom of the head, wherein one of or each of the crown portion and the sole portion is provided with a plurality of grooves bent in a same direction, and wherein said plurality of grooves are shifted toward a toe of the head or toward a heel of the head.

9. The golf club head according to claim 1, wherein said a claim 8, wherein said plurality of grooves are shifted toward a heel of the head.

10. The golf club head according to claim 8, wherein said plurality of grooves are shifted toward a toe of the head.

11. A golf club head having a hollow therein and comprising:

a face portion having a face for striking a ball;

a crown portion forming a top surface of the head; and a sole portion forming a bottom of the head, wherein one of or each of the crown portion and the sole portion is provided with a plurality of grooves bent in a same direction, and wherein said plurality of grooves are arranged in a heel side of the head and also in a toe side of the head.

* * * * *